United States Patent [19]

Couvrette

[11] 4,422,189

[45] Dec. 27, 1983

[54] TOILET SEAT SANITARY FIXTURE

[76] Inventor: Guy Couvrette, 135, 19e Rue, Laval, Quebec, Canada, H7N 1E7

[21] Appl. No.: 322,323

[22] Filed: Nov. 17, 1981

[51] Int. Cl.[3] ..... A47K 4/00

[52] U.S. Cl. ..... 4/420.2; 4/420.4; 4/443

[58] Field of Search ..... 4/420.1–420.5, 4/443–448

[56] References Cited

U.S. PATENT DOCUMENTS

| | | | |
|---|---|---|---|
| 2,872,687 | 2/1959 | Maurer . | |
| 2,875,450 | 3/1959 | Umann | 4/447 |
| 3,154,793 | 11/1964 | Congdon . | |
| 3,247,524 | 4/1966 | Umann . | |
| 3,430,267 | 3/1969 | Van Houten . | |
| 3,430,268 | 3/1969 | Zoberg | 4/420.1 |
| 3,545,015 | 12/1970 | Richardson, Jr. et al. . | |
| 3,594,826 | 7/1971 | Maurer . | |
| 4,028,745 | 6/1977 | Caniglia | 4/420.2 |
| 4,062,072 | 12/1977 | Roberts | 4/420.4 |
| 4,237,560 | 12/1980 | Riegelman et al. | 4/420.2 X |
| 4,326,308 | 4/1982 | Silver | 4/420.4 X |

FOREIGN PATENT DOCUMENTS

| | | |
|---|---|---|
| 494367 | 7/1953 | Canada . |
| 556213 | 4/1958 | Canada . |
| 578504 | 6/1959 | Canada . |
| 638751 | 3/1962 | Canada . |
| 759638 | 5/1967 | Canada . |
| 763636 | 7/1967 | Canada . |
| 808352 | 3/1969 | Canada . |
| 810852 | 4/1969 | Canada . |
| 870305 | 5/1971 | Canada . |
| 915352 | 11/1972 | Canada . |
| 958152 | 11/1974 | Canada . |
| 973303 | 8/1974 | Canada . |

*Primary Examiner*—Charles E. Phillips

*Attorney, Agent, or Firm*—Ferguson, Baker, Whitham, Spooner & Kroboth

[57] ABSTRACT

A bidet of small size, that can be mounted on a toilet bowl of any conventional structure without preliminary adjustment. This bidet whose function is to spray one or two water streams of adjustable temperature toward the anus or the genital parts of the toilet's user when seated onto the toilet bowl, then to dry the so sprayed parts of the body by means of a reversible fan blowing air at an adjustable temperature, and to drive out of the room the polluted air and vapor structurally comprises a thin oval-shaped element that can be fixed to the toilet bowl between the upper periphery of the bowl and the toilet seat, and a casing of very small dimension that is rigidly fixed by its upper wall to the rear of the thin element and that extends in a direction parallel to the longitudinal axis of the toilet bowl without overheighting the plane in which extends the toilet seat. Mechanical or electrical devices for performing the above-mentioned functions are located inside these element and casing in such a manner that they may be easily adjusted or operated by the user.

9 Claims, 12 Drawing Figures

TOILET SEAT SANITARY FIXTURE

The present invention relates to an hygienic apparatus generally known under the name of "bidet", which can be mounted onto any kind of toilet bowl of a conventional structure, and used in combination with this toilet bowl for sanitary purpose.

Numerous models of hygienic bidets that can be used in combination with, or in association to, a toilet bowl, are known, such as those described in U.S. Pat. Nos. 2,872,687 (Maurer), 3,154,793 (Congdon), 3,247,524 (Umann), 3,430,267 (Van Houten), 3,545,015 (Richardson Jr. et al) or 3,594,826 (Maurer). All these known models of bidet comprise means for spraying a stream of water of adjustable temperature toward the anus or the genital parts of the body of the toilet's user when this user is seated onto the toilet bowl. Some models are also provided with means for drying the sprayed parts of the body, these drying means generally consisting of a fan blowing air at an adjustable temperature.

These known modifications of bidet generally work in satisfactory manner but they all present some problems. Some models such as those described in U.S. Pat. Nos. 2,872,687 or 3,594,826 involve a substantial modification or even complete removal of the original toilet system, which is of course very expensive.

Other known models, such as those described in U.S. Pat. Nos. 3,154,793; 3,247,524 or 3,545,015 can be used in combination with a toilet bowl having a conventional structure. However, they have the problem of being fixed in a rigid manner to a toilet seat substantially different from any conventional seat, and of having a casing that is interposed between the water tank and the rear of the toilet bowl and restricts the room left available to the user for taking place onto the seat. They also have the problem of requiring a preliminary adjustment of the height of the seat so that this seat may be at a suitable level for laying in a flat manner onto the upper periphery of the bowl. In addition of the abovementioned problems, some other models of known bidet have the drawbacks of being, on one hand, substantially cumbersome and, on the other hand, not easy to operate or adjust, in particular when the user must support himself or herself, or the operator who can be a nurse in the case of a bidet used in a hospital, must hold the user with his or her two hands.

The object of the present invention is to provide a bidet that overcome all the above-mentioned drawbacks.

More particularly, the object of the present invention is to provide a hygienic bidet of small size that can be adapted without any premilinary adjustment to any kind of toilet bowl of conventional structure, even when located in a relatively exiguous room, and whose operation is simple, easy to carry out, safe and can be made either manually or by means of a foot pedal.

The bidet according to the invention that can be used in combination with a standard toilet including a toilet bowl and a toilet seat located in a toilet room comprises:

(A) a thin, oval-shaped element fixed to the toilet bowl between the upper periphery of the bowl and the toilet seat, and (B) a small casing having a upper wall which is rigidly fixed to the rear the thin element and extends in a direction parallel to the longitudinal axis of the toilet bowl without overheighting the plane in which extends the toilet seat.

In accordance with the invention, the thin element comprises:

Further characteristics and advantages of the bidet according to the invention will be better understood from the following description of the preferred embodiment thereof, made with reference to the accompanying drawings in which.

Figure 1:
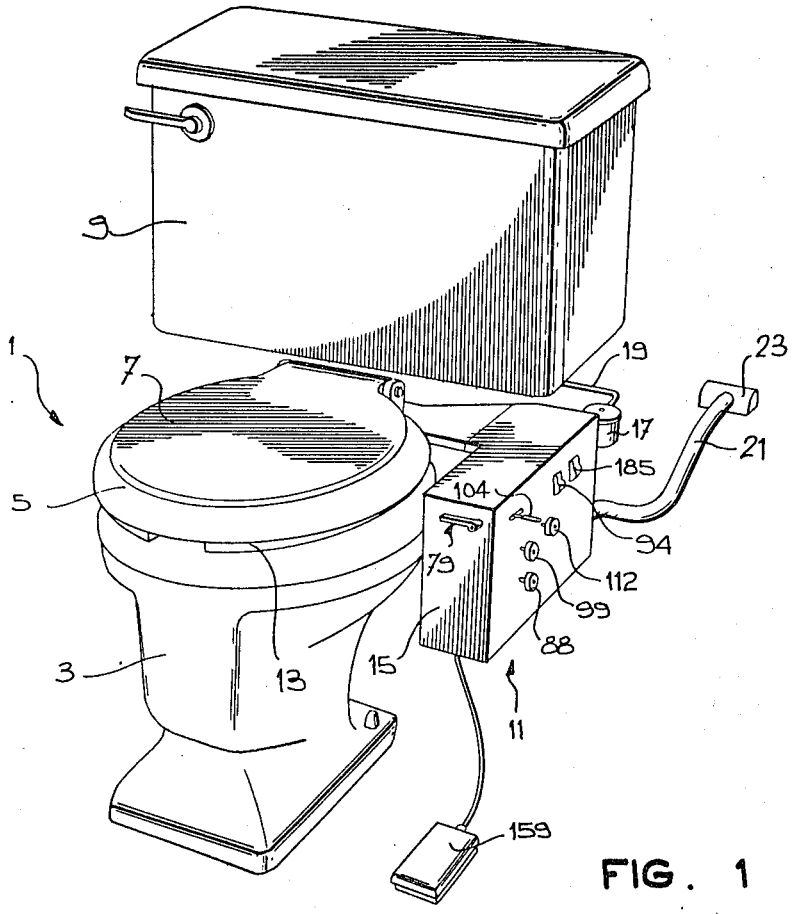
FIG. 1 is a perspective view of a toilet bowl and seat provided with a bidet according to the invention.
Figure 5:
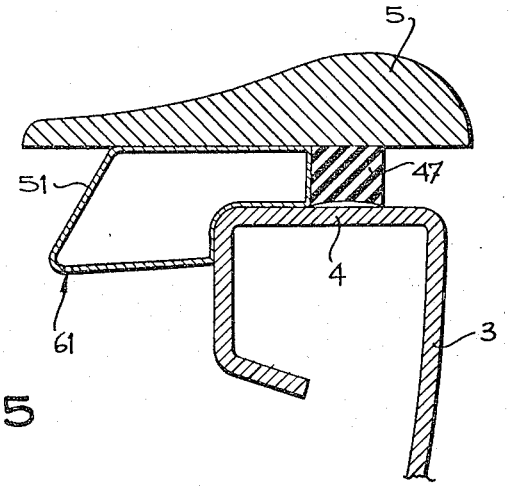
Figure 4:
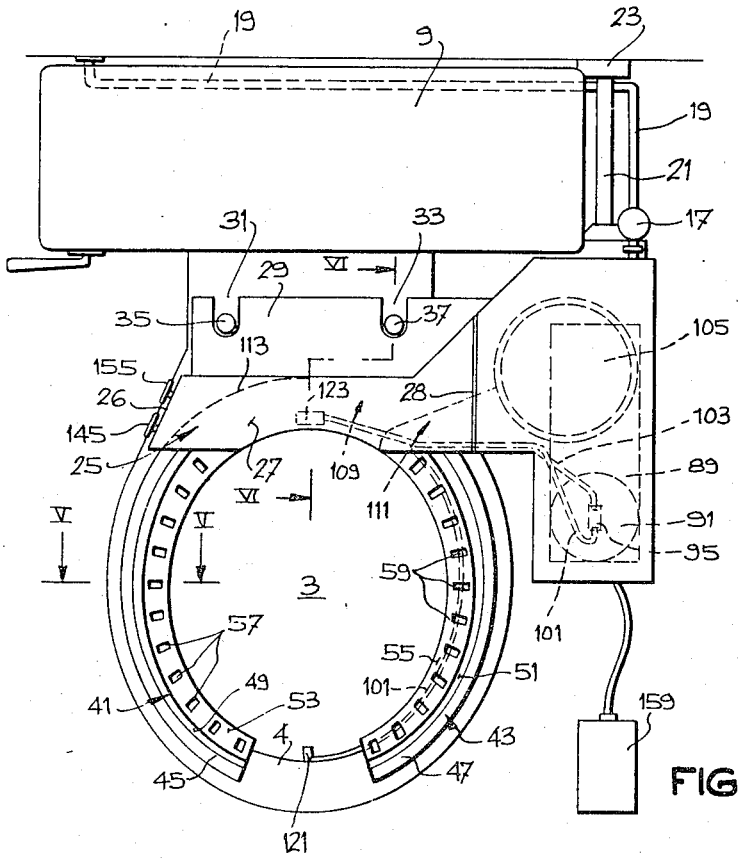
FIG. 4 is a top plan view of the whole toilet shown on FIG. 1.
Figure 7:
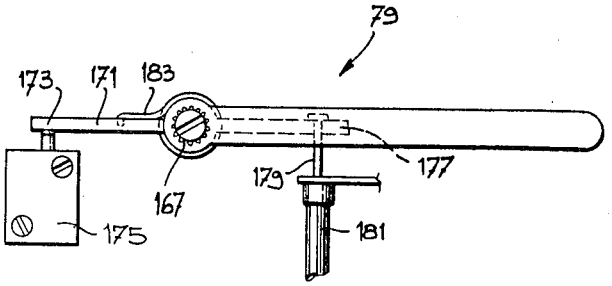
Figure 8:
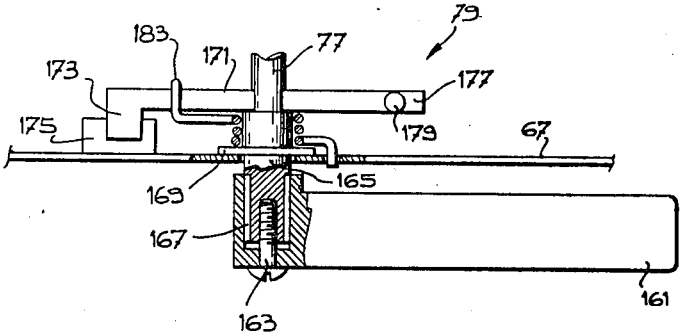
Figure 6:
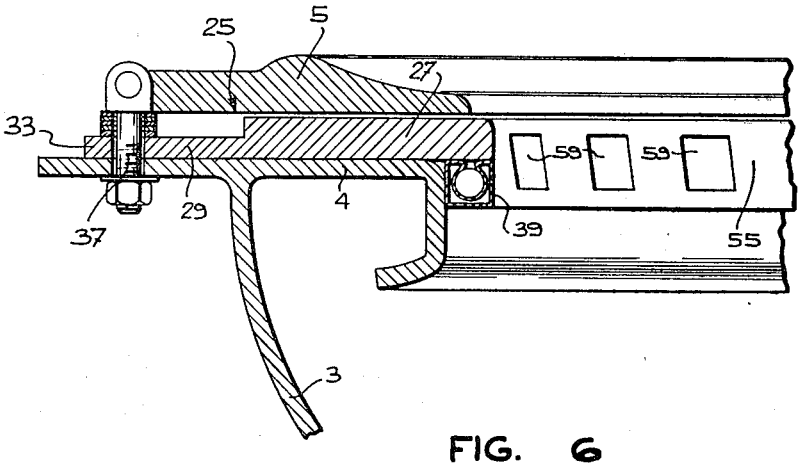
Figure 9:
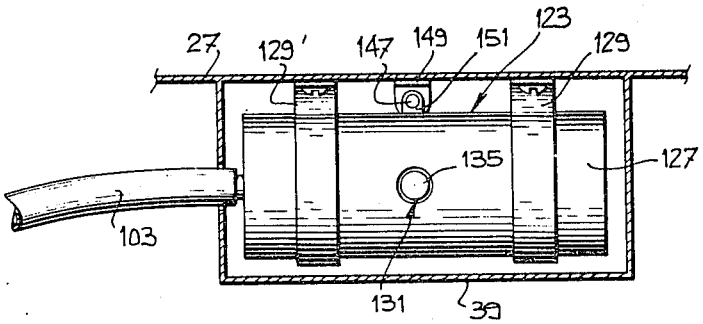
Figure 10:
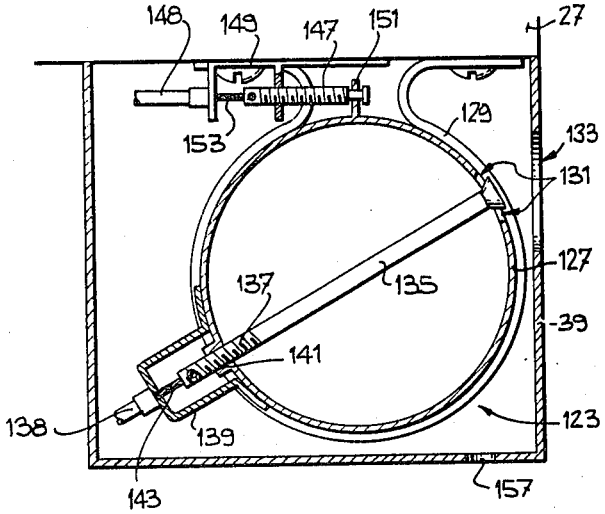
Figure 11:
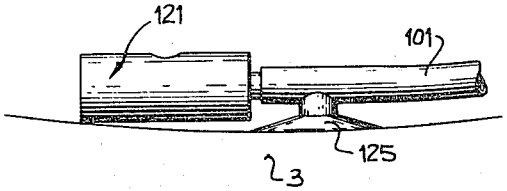

FIG. 5 which appears on the same sheet of drawings as FIG. 1, is a cross-sectional view of the thin element of the bidet taken along line V—V as indicated on FIG. 4;

FIG. 6 is a cross-sectional view of the thin element of the bidet, taken along line VI—VI as indicated on FIG. 4;

FIG. 7 is a front elevational view of the device for controlling the water supply valve;

FIG. 8 is a top plan view of the device shown on FIG. 7;

FIG 9 is a front elevational view of the first nozzle forming part of the thin element;

FIG. 10 is a side elevational view in cross-section of the nozzle shown on FIG. 9;

FIG. 11 is a top plan view of the second nozzle of the thin member; and

Figure 12:
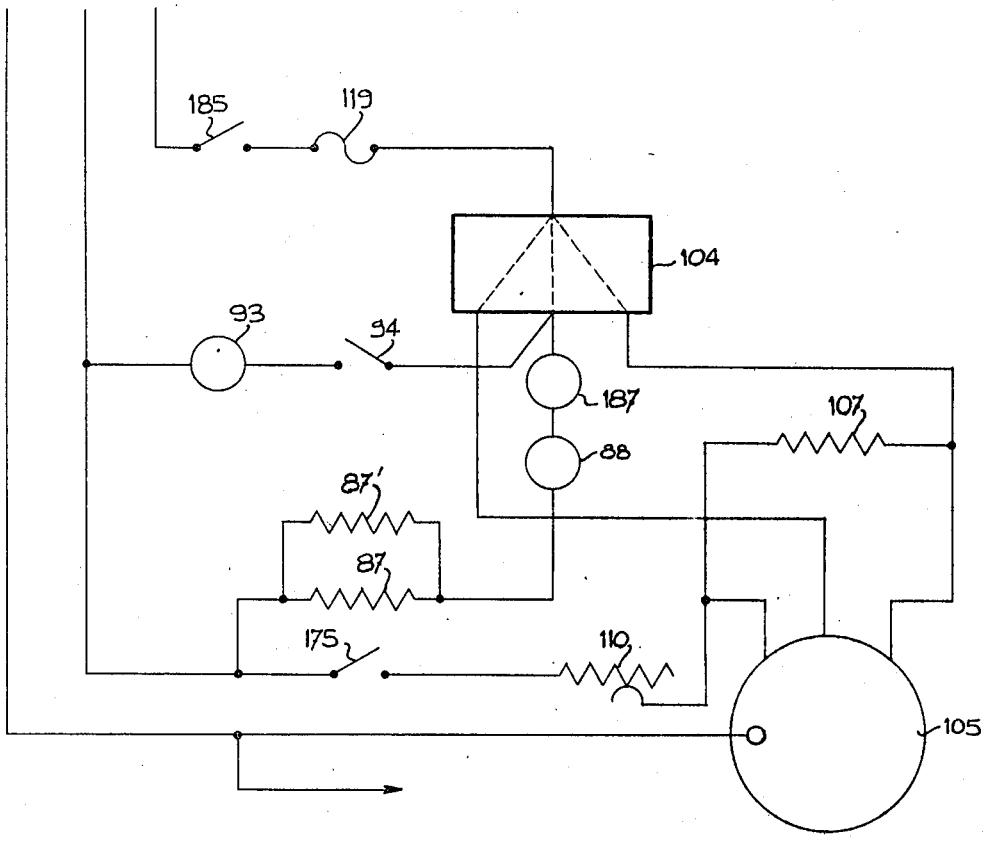

FIG. 12 is a diagram of the electrical circuit enclosed with the casing.

FIG. 1 shows a toilet bowl of conventional structure, comprising a toilet bowl 3 made of stoneware, a toilet seat 5 made of plastics and fixed at the rear of the bowl 3 in a raisable manner, a lid 7 also made of plastic and fixed at the rear of the seat 5 in an openable and closable manner, and a water tank or flush 9 mounted behind the bowl 3.

FIG. 1 also shows an embodiment of bidet 11 according to the invention. This bidet comprises a thin element 13 having the general shape of slightly opened oval fixed to the toilet bowl 3 between the upper periphery of this bowl and the seat 5, and a casing 15 of small dimension which is rigidly fixed by its upper well to the thin element, at the rear of the toilet bowl 3, and extends parallel to the longitudinal axis of the bowl without exceeding the length of the same and without overheighting the plane in which extends the toilet seat 5 in order to ensure a maximum available room and therefore a maximum comfort to the user, while reducing the surface occupied onto the floor.

The casing 15 is connected to an electrical power source by means of a wire (not shown) and is also connected by means of a water supply conduct 19 to a supply of cold water under pressure, that can be the same as that to which is connected the flush 9. If desired, a water filter 17 can be mounted onto the water supply conduct 19 so as to be easily accessible and washable. This filter 17 can be used for purifying the water if this water is hard, rusty or sandy. The casing 15 is also connected to the outside of the room, which room may be a toilet room or bath room containing the toilet 1, by means of an exhaust 21 fixed in a removable manner to the wall or to a window of the room by a plug 23.

Figure 2:
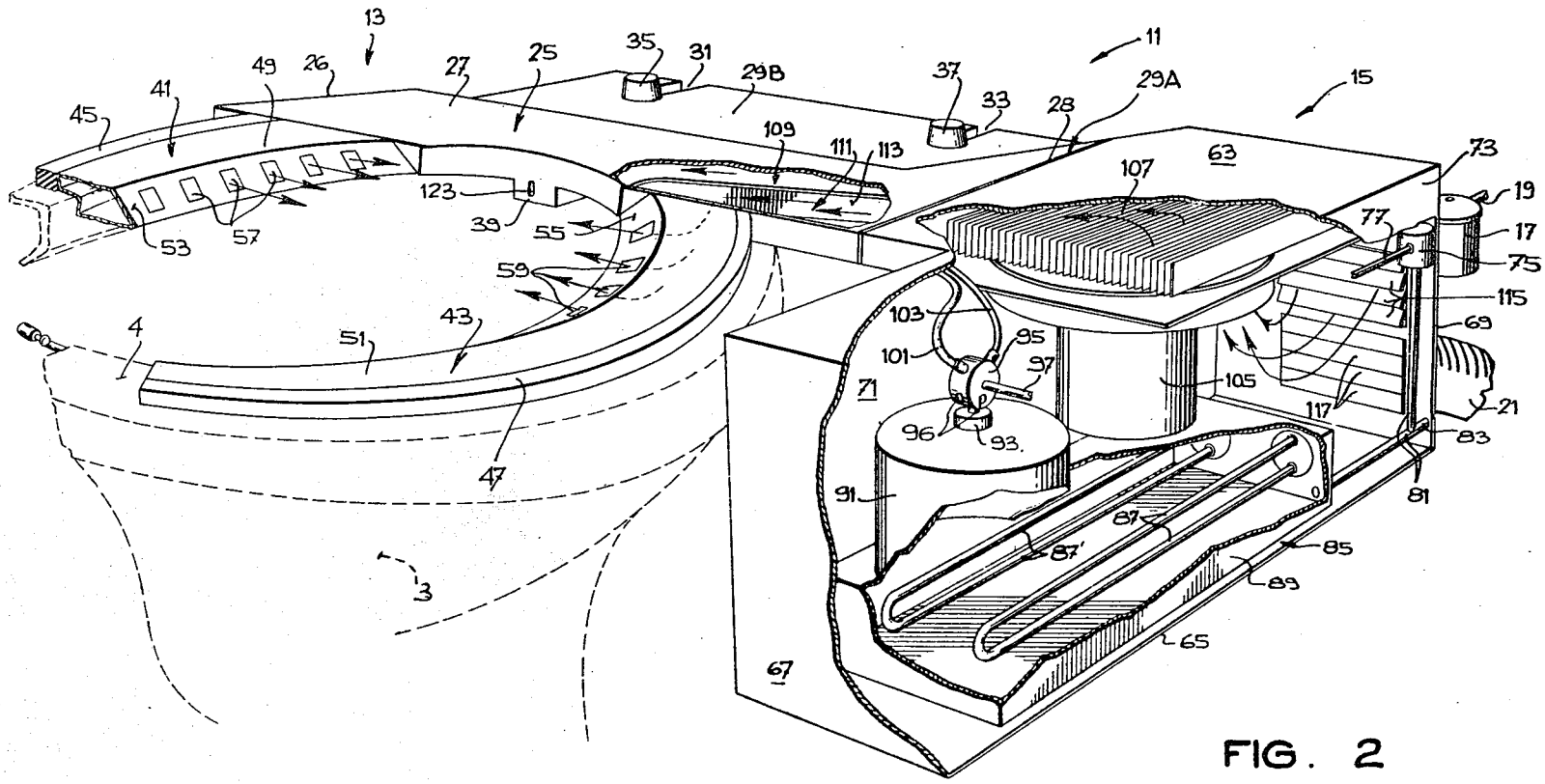
FIG. 2 is an exploded perspective view of the bidet shown on FIG. 1.

With particular reference to FIGS. 2 and 4, the thin element 13 of the bidet 11 comprises a rear section 25 extending in a direction parallel to the vertical surface of the tank 9 over the whole width of the toilet bowl 3, and two lateral sections 41 and 43 that are symmetrical and have the same thickness as the rear section 25. These lateral sections form together with the rear section a wide oval slightly opened, which oval substantially follows the upper edge 4 of the toilet bowl 3 onto which the element 13 lays.

The size of the oval formed by sections 25, 41 and 43 is selected to be slightly smaller than the size of the internal periphery of the upper edge 4 of the bowl 3, to allow the element 13 to be completely covered and hidden by the toilet seat 5.

The rear section 25 comprises a main body 27 having substantially the shape of a rectangular trapezium of a small height, whose small tapering side 26 is substantially tangent to the periphery of the external edge of the rear of the bowl 3, and the other small side 28 perpendicular to the bases is extended by a converting member 29*a* if necessary. This member 29*a* is of variable dimension and may be inserted between the rear section 25 of the element 13 and the casing 15 to adapt this casing to the different dimension of the conventional toilet bowl 3. The body 27 is provided with a extension 39 projecting under its lower surface in the middle thereof, rearwardly of the closed space defined by the upper periphery of the toilet bowl 3. This extension 39 encloses a nozzle 123 used for spraying a water stream, whose structure and function will be described hereinafter.

The rear section 25 also comprises an integral flap 29B which extends the element 27 rearwardly in the direction of the flush 9. This rear flap 29 is used for fixing the bidet 11 to the toilet 1. For this purpose, the flap 29B is provided with two slots 31 and 33 which extend parallel to the longitudinal axis of the toilet bowl from the rear to the front thereof. These slots 31 and 33 permit to slide the rear flap 29B onto the bolts 35 and 37 that form part of the bowl 3 and are used to fix the toilet seat 5, as shown on FIG. 6.

The lateral sections 41 and 43 of this element 13, that are symetrical with respect to the longitudinal axis of the toilet bowl 3, each comprise an external molding 45 and 47 made of rigid plastic material. These modings lay in a flat manner onto the upper periphery 4 of the bowl 3 to support the toilet seat 5 that is mounted over it in a plane strictly parallel to the upper periphery of the bowl. These lateral sections 41 and 43 are advantageously removable to ease their cleaning and are fixed by a plurality of suction-cups located at spand-apart intervals alay their lengths.

The lateral sections 41 and 43 also comprise two hollow members 49 and 51 which extend from the moldings 45 and 47 towards the center of toilet bowl, slightly beyond and under the upper periphery 4 of the bowl 3, as can be seen on FIG. 5. These hollow members 49 and 51 that are made of a more flexible plastic material than the moldings 45 and 47 each define an air-duct extending on each side of the toilet bowl 3. Preferably, these members 49 and 51 are tapering towards the front of the toilet bowl to provide a better distribution of the air.

The walls 53 and 55 of the members 49 and 51, which are adjacent to the center of the toilet bowl 3 are slightly tapering from bottom to top and extend towards the external periphery of the bowl at an angle about 45°. These walls are each provided with air vents 57 and 59 arranged parallel to each other along the whole lengths of the members. This particular shape given to the walls 53 and 55 has a double purpose. First of all, it avoids that splashes occuring by inadvertance when use is made of the toilet bowl or of the bidet, enter the air vents 57 and 59 and fill up and soil the inside walls of the lateral sections 41 and 43. In this connection, use can be made of a plurality of drain holes 61 through the bottom of the sections 41 and 43, as shown of FIG. 5. The second purpose of the particular shape given to the walls 53 and 55 is to direct the axes of the air vent 57 and 59 slightly upwards to draw or blow air in this particular direction and thus to ensure better drying of the water sprayed parts of the body.

As indicated hereinabove, the thin, hollow element 13 is connected to a casing 15 containing the various operating devices of the hygienic bidet 11.

Figure 3:
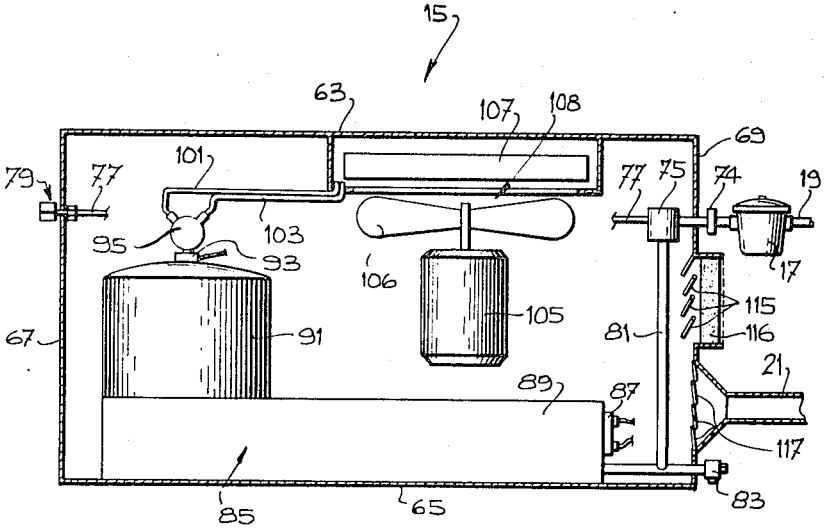
FIG. 3 is a side elevational, cross-sectional view of the casing of the bidet shown on FIG. 2.

Referring now specifically to FIGS. 2 and 3, the casing 15 has an elongated, parallepipedic shape with an upper wall 63, a lower wall 65, a front wall 67, a rear wall 69 and two lateral walls 71 and 73. The wall 73 can be removable and then acts as an access panel.

The casing 15 is oriented in a direction parallel to the longitudinal axis of the toilet bowl 3 and is fixed to the hollow element 13 by means of the body 27 to the small wall 28 of which it is connected. The casing 15 is mounted so that its upper wall 63 be at the same level as the upper surface of the rear section 25 of the hollow element 13 and its front wall 67 be slightly set back from the front end of the toilet bowl 3. As previously indicated, this particular size choosen for the casing 15 advantageous reduces the room necessary for locating the hygienic bidet 11 and allows the bidet's user to seat on the toilet seat 5 in a comfortable manner while keeping at the arm's length, the knobs or handles used for operating or adjusting the mechanical or electrical devices located inside the casing 15. As already indicated hereinabove, the casing 15 is connected to a cold water source under pressure by means of the water supply conduct 19 via a water filter 17. The water conduct 19 is used for supplying a water tank 85 located inside the casing 15. The water tank 85 inside the casing 15 is supplied by means of an internal water pipe 81 connected by means of a removable joint 74 at the outlet of the water filter 17. The internal water pipe 81 is provided with an inlet valve 75 operated by a shaft 77 connected to a control latch that will be described hereinafter in more detail. The inlet valve 75 is used to open or close the water circuit. This inlet valve 75 can also be used for gradually adjusting the pressure of water when the water circuit is opened.

The internal water pipe 81 is also provided with an additional valve 83 for draining the water circuit when necessary. Of course, the inlet of the internal pipe 81 into the water tank 85 is located in the bottom of this tank at a level higher or at least equal to the level at which is located the valve 83 to allow draining of the circuit.

The water tank 85 is provided with two electrical heating elements 87 and 87′ for heating the water supplied by the internal pipe 81. These heating elements 87 and 87′ are controlled by means of an adjustable thermostat whose command 88 is mounted at the outside of the casing at the arm's length of the user.

Preferably, the water tank 85 is located in the bottom of the casing 15 so that the convection heat lost by the hot water may raise up and thus be transmitted in a permanent manner to the hollow element 13 and therefrom to the toilet seat 5 which becomes much more comfortable and pleasant to seat.

The water tank 85 structurally comprises a main compartment 89 containing the heating elements 87 and 87' and a secondary compartment 91 used for storing a given amount of already heated water to permit immediate use of the hygienic bidet 11. This secondary compartment 91 is located over the main compartment 89 at a part thereof opposite to the part into which the cold water is introduced by the internal pipe 81.

At the outlet of the secondary compartment 91 of the tank 85 is mounted an electrical pulse device 93 that can be operated from the outside of the casing 11 by a switch 94. Thus pulse device 93 is used for varying in a repetitive manner the pressure of the water sprayed towards the anus and/or genital part and/or the whole seat of the body of the bidet's user. This arrangement advantageously permits to give the water massage of the seat's user, which massage can be of a great medical utility in some cases.

Just downstream the pulse device 93 is mounted a distributor 95 operated by a shaft 97 connected to an easily operable control known 99 located outside of the casing 15. This distributor 95 is used for directing the hot water leaving the secondary compartment 91 of the tank 85 either towards the first water conduct 101 or a second water conduct 103 or both of them simultaneously.

The distributor 95 is provided with a plurality of openings 96 than can be connected to a dispensing apparatus (not shown), for medicinal products which dispensing apparatus may consist of a pressure operated bottle or a syringe.

The water conduct 103 extends from the casing 15 to the rear section 25 of the hollow member 13 and supplies a first nozzle 123 located in the extension 39 projecting downwardly under the lower surface of the rear section 25.

The water conduct 101 extends from the casing 15 to the rear section 25 of the hollow member 13 and then to the lateral section 43 up to the front end of which it extends to supply with water a second interchangeable nozzle 121.

This second nozzle 121 is intended to be fixed directly onto the toilet bowl 3 at the front thereof in order to spray water towards the genital part of the body of the bidet's user. This arrangement is particularly advantageous as it prevents the bidet's user and more particularly the female users to be obliged to seat astride in rear position onto the toilet seat to wash themselves. The nozzle 121 can be fixed to the toilet bowl 3 by any conventional means, such as, for example, by means of a suction-cup 125 as shown on FIG. 11. The use, positioning and orientation of this nozzle 121 are left to the user's requirements.

In addition to the above described water circuit, the casing 15 also comprises an air circuit.

This air circuit comprises an inlet 115 and an outlet 117 extending through the rear wall 69 of the casing 15. The inlet 115 comprises a clack valve comprising a plurality of superimposed plates that may open from the outside of the wall 69 towards the inside of the casing 15. The outlet 117 also comprises a clack valve comprising a plurality of superimposed plates opening from the inside of the casing 15 towards the outside of the wall 69.

The inlet 115 opens to the ambient air of the room in which is mounted the toilet 1 and allows this ambient air to be drawn inside the casing 15 via an air filter 116 easy to remove and replace.

On the other hand, the outlet 117 is connected to the exhaust 21 fixed in a removable manner to the wall of the room by means of its plug 23 so that the air leaving the casing 15 be not blown back into the room but out of the same. This arrangement advantageously permits one to get rid of the polluted air and bad smell, either when using the bidet or simply when using the toilet. The air circuit of the casing 15 also comprises an electrical air fan operating in a reversible manner and comprising a motor 105 and a fan 106 as such. The motor 105 is connected to a three-position switch 104 in order to completely switch off the fan and to switch it on in one or the other direction. When the fan is switched on in blowing position, the switch 104 also switches on an heating element 107 to heat the ambient air drawn from the toilet room.

The fan 105 is used for drawing or blowing air through the air vents 57 and 59 to the members 41 and 43 of the hollow element 13. For this purpose, the fan is located at the end of a large air duct 108 forming an integral part of the casing 15. This large duct 108 is extended by the rear section 25 of the hollow member 11 where it is divided out into the first duct 109 and a second duct 111 separated by a wall 113 in order to respectively supply with air the hollow members 49 and 51.

As aforesaid, an electrical heating system 107 of a conventional type is mounted inside the duct 108 close to the fan 106 for preheating the air blown by this fan. This heating system 107 and the motor 105 are connected to a rheostat 110 operated from the outside of the casing 15 by means of a control knob 112 easily accessible by the user, to allow adjustment of the temperature and force of the air blown by the fan towards the air vents 57 and 59 of the hollow member 13, when this fan is used to blow air.

In this case, the ambient air is drawn from the outside to the inside of the casing 15 through the inlet 115 and is subsequently blown through the ducts 108, 109 and 111, the members 49 and 51 and the air vents 57 and 59 towards the center of the closed space defined by the upper periphery 4 the toilet bowl. The air drawn from the outside and blown towards the center of the toilet bowl is heated by the heating system 107 and thus ensures quick and pleasant drying of the seat of the bidet's user thanks to the air temperature and force control.

When the fan 105 is switched on in drawing position, the polluted air present in the closed space defined by the upper periphery of the toilet bowl is drawn by the air vents 57 and 59 and follows the same way as previously indicated until it reaches the inside of the casing 15 from which is blown outside the room where is located the toilet via the outlet 117 and exhaust 21.

As already indicated, the hygienic bidet 11 comprises two nozzles respectively numbered 121 and 123 for spraying the water heated in the water tank 85 towards the anus, the genital parts or the whole seat of the body of the bidet's user when this user is seated onto the toilet bowl. The second nozzle numbered 121 is intended to spray water from the water bowl toward the genital parts of the body of the user. This nozzle 121 is fixed directly onto the toilet bowl, as already described in connection with FIG. 11 of the drawings. This nozzle 121 is advantageously designed to be a removable and interchangeable with other similar nozzles, to adjust the speed and the angle of spray as desired.

The first nozzle 123 which, as aforesaid, is mounted in the extension 39 projecting downwardly under the lower surface of the rear section 25 of the hollow element 11, is used for spraying water from the rear of the toilet bowl, toward the anus of the user or the seat of the same, in order to clean this user and/or heat him or her while relieving pain in the case of a person having haemorrhoids or seat sores.

To provide confort and the best possible treatment to the user especially in the case of a person having painful haemorrhoids, the first nozzle 123 is provided with means for adjusting the pressure of the spray, and means for orientating this spray according to the user's requirements.

With particular reference to FIGS. 9 and 10, the first nozzle 123 located inside the extension 39, has the general shape of a hollow cylinder 127 having a horizontal axis. This cylinder is held inside the extension 39 by means of two rings 139 and 129' fixed to the internal wall of the section 27. This cylinder 127 has one of its ends connected to the water supply conduct 103 coming from the casing 15 and has the middle of its periphery provided with an opening 131 mounted in front of a larger opening 139 provided through the extension 39 to allow the water supplied by the conduct 33 to be sprayed from the opening 131 towards the center of the space defined by the upper periphery of the bowl. To allow adjustment of the spray, a needle 135 is mounted in the middle of the opening 131. This needle extends in a diagonal directing through the hollow cylinder 127 and passes through the wall of the same, at a point 141 opposite to the opening 131. Part of the length of the needle 135 opposite to the opening 131 is provided with a thread 137 that can be screwed in one way or in the other way through the wall of the hollow cylinder 12 at 141 to move frontwardly or rearwardly the head of the needle 135 and thus to enlarge or narrow the opening 131 according to the user's requirements.

The screwing of the needle 135 to adjust the angle of the spray from 5° to 30° is carried out by means of a flexible cable 143 having one end fixed to the threaded end of the needle 135 and the other end fixed to a rotating knob 145 mounted onto the external side of the small side 26 of the main section 27 of the hollow member 17 (see FIG. 4). The cable 143 can be mounted inside a sleeve 138 fixed in a rigid manner to the hollow cylinder 137 by means of a brace 139, as shown on FIG. 10.

To allow adjustment of the orientation of the spray with respect to an horizontal plane, the hollow cylinder is mounted so as to rotate about its axis inside its fixing rings 129 and 129' in order to modify the angle between the axis of the opening 131 and an horizontal plane either in upwards or downwards direction.

The hollow cylinder 127 is rotated by means of an endless screw 147 fixed in a rigid manner directly to a bottom wall of section 127 by a brace 149. One extremity of this endless screw is fixed to a small tongue 151 welded directly onto the cylinder 127. The other end of the screw 147 is fixed to a flexible cable 153 mounted in a sleeve 148, which cable is designed to rotate the endless screw 147 in one way or in other and consequently to rotate the hollow cylinder 127 by its tongue 151 about its axis.

The free end of the cable 153 is connected to a rotating knob 155 identical to the knob 145 and fixed beside the same on the small wall 26.

Advantageously, the bottom of the extension 39 is provided with a drain hole 157 as shown in FIG. 10, to allow evacuation of the splashes that may occur by inadvertance when use is made of the toilet bowl.

In a particularly advantageous embodiment of the invention, the water inlet valve 75 is used for opening and closing the water circuit and for regulating the water pressure when the circuit is opened. This valve 75 is mounted in such a manner that it may be operated either manually by a handle 161, or by foot through a pedal 159 (see FIGS. 1 and 4 The use of such a foot pedal allows the user to support himself or herself if necessary, or a nurse to support a patient onto the toilet bowl with both arms while simultaneously operating the bidet.

Advantageously, the control system 79 connected to the inlet valve 75 by a shaft 77 as described hereinabove, is designed to be operated either by the handle 161 and the pedal 159.

Referring now to FIGS. 7 and 8, the control system 79 comprises a sleeve 165 fixed in a rigid manner to the end of the shaft 77 and extending the same through the front wall 67 of the casing 15. This sleeve 165 is provided with a flange 169 mounted inside the casing 15 to close the slack that may exist between the sleeve 165 and the corresponding opening made through the front wall 67. The handle 161 is mounted onto the sleeve at the outside of the front wall 67 in a removable manner by means of a screw 163. To avoid rotation of the handle 161 about the sleeve 165, both of them can be provided with matching notches 167 to provide full transmission of the force applied to the handle to the shaft 77.

The handle 161 is permanently pulled back in an horizontal position in which the water inlet valve 75 is closed, by means of a spiral spring 183 mounted about the sleeve 161 with one extremity fixed to the front wall 67 and the other urging against a small rod 171 welded directly onto the shaft 77 inside the casing.

For an obvious purpose of safety, a switch 175 is mounted at the end 173 of the rod 171. This switch is used for automatically switching off the motor 105 of the fan and the heating element 107 as soon as water is sprayed towards the anus, the genital parts or the whole seat of the toilet's user by the nozzles 121 and 123. This switch 175 can be a simple pressure bottom which switches off the circuit as soon as the end 173 of the rod 171 is raised up by operation of the handle 161 or pedal 159.

In order to operate the control system 179 with the handle 161 as well as with the pedal 159, the small rod 171 extends on the other side of the shaft 77 and is fixed by its free end 177 to a cable 179 mounted in a sleeve 181 extending from the housing 15 to the pedal 159. By simple pressure of the foot onto the pedal 159, the cable 179 is pulled downwardly and operates the water inlet valve in the same manner as the handle 161, which of course improves the use of the hygienic bidet 11.

The pedal 159 can be mounted in series with other similar pedals for operating the fan in one way of the other as well as the pulse device, respectively.

The electrical circuit inside the casing 15 is shown on FIG. 12. This circuit which is protected by a fuse 119 and grounded, is connected to the electrical power network and provided with a main switch 185 operable from the outside of the housing casing (see FIG. 1). This circuit includes the motor 105 of the fan and heating element 107 that are connected through the reversible switch 104 to switch off completely or to operate in one way or the other way the motor 105. The reversible switch 104 may be operated by a small lever as shown on FIG. 1, which lever is directly associated to a rheostat 110 for varying the speed of the motor 105 and simultaneously the power supplied to the heating element 107. The reversible switch 104 electrically switches on in a permanent manner the heating elements 87 and 87' as soon as the lever is pulled back in its middle position, to obtain a continuous heating of the water inside the tank 85 as soon as the fan is stopped.

As previously indicated, one of the wires supplying the motor 105 and the heating element 107 is also connected to the switch 175 used for automatically switching off the circuit as soon as the water inlet valve is opened.

The electrical device 93 and its switch 94 used for varying in a repetitive manner the pressure of the water spray is mounted in shunt onto the electrical circuit, as well as are the heating elements 87 and 87' and their adjustable thermostats 88. On this shunt is mounted a safety thermostat 187 for automatically switching off the current when the temperature of the water inside the water tank is higher than a predetermined value, such as, for example 40° C., to avoid overheating of the whole apparatus and to reduce the risks of accident. This thermostat 187 is adjusted at the manufacture to avoid that the toilet's user misadjusts it.

As can now be understood, the circuit when switched on by the main switch 185 ensure permanent heating of the water inside the water tank 85 by means of the heating element 87 and 87' while the motor and the heating element 107 or the pulse device 93 needs to be operated by their specific control means 104 and 94 respectively.

The hygienic bidet described hereinabove can be used anywhere but, in a more general manner, preferably in hospital or in any place where the working people must be perfectly clean. This kind of hygienic bidet is particularly useful for those having painful haemmorrhoids as it permits to perfectly adjust the temperature of water, the pressure and orientation of the water spray while providing full drying of the body without any manual contact that can be particularly painful.

In the case of a family having young children, the hygienic bidet 11 can be provided with a safety system for locking all the knobs or control means. This locking system can also be used at other places, such as, for example, in hospitals.

I claim:

1. A bidet for use in combination with a standard toilet including a toilet bowl and a toilet seat located in a toilet room, said bidet comprising:

(A) a thin oval-shaped element fixed to the toilet bowl between the upper periphery of the toilet bowl and the toilet seat, said thin element comprising:

(a) means for fixing it to the toilet bowl;

(b) an air duct extending along the whole length of the element;

(c) a plurality of air vents symetrically arranged with respect to the longitudinal axis of the toilet bowl which extend between the air duct and the closed space defined by the upper periphery of the toilet bowl;

(d) a first water conduct connected to a first nozzle located in the middle of the rear part of the thin element for spraying water toward the center of the closed space defined by the upper periphery of the toilet bowl;

(e) means for orientating and adjusting the pressure of the first nozzle spray;

(f) a second water conduct connected to a second nozzle located in the middle of the front part of the toilet bowl for spraying water toward the center of the closed space defined by the upper periphery of the toilet bowl; and (B) a small casing having an upper wall rigidly fixed to the rear of the thin element and extending in a direction parallel to the longitudinal axis of the toilet bowl without overheighting the plane in which extends the toilet seat, said casing comprising:

(a) a water supply conduct connected to a supply of cold water under pressure, external to the casing;

(b) a first valve controlled from the outside of the casing for opening or closing the water supply conduct;

(c) a water tank provided with an inlet connected to the water supply conduct, and an outlet;

(d) electrical heating means adjustable from the outside of the casing for heating water inside the tank;

(e) distribution means connecting the outlet of the tank to the first and second water conducts of the thin element said distribution means including a second valve controlled from the outside of the casing for directing the water contained in the tank either to the first nozzle via the first conduct or to the second nozzle via the second conduct or to both nozzles via both conducts;

(f) a reversible fan controlled from the outside of the casing and connected to the air duct extending along the thin element for drawing or blowing air through the air vents of said thin element;

(g) a first clack-valve allowing entry of ambient air inside the casing in order to supply the fan when this fan is blowing;

(h) a second clack-valve allowing exit of the air drawn by the fan when the fan is drawing, toward an exhaust external to the casing and connected to the outside of the toilet room; and (i) electrical heating means controlled from the outside of the casing for heating the ambient air drawn by the fan and blown through the air vents of the thin element.

2. A bidet according to claim 1, wherein said means for fixing the thin element to the toilet bowl comprises a flap integrally extending the thin element, said flap being fixable to the conventional means used for fixing the toilet seat to the toilet bowl.

3. A bidet according to claim 2, wherein said means for orientating and adjusting the pressure of the first nozzle spray comprises a first cable fixed to a needle extending through the outlet of the first nozzle in order to open or close this outlet by rotation of the cable, and a second cable fixed to an endless screw associated to the first nozzle in order to rotate this first nozzle about a horizontal axis by mere rotation of the second cable.

4. A bidet according to claim 1, 2 or 3, wherein the second nozzle located in the middle of the front part of the toilet bowl is fixed directly to the wall of the toilet bowl by a suction cup.

5. A bidet according to claim 1, 2 or 3, wherein the water tank is located in the bottom of the casing in order to permanently heat the toilet seat by mere heating of the air contained in the casing.

6. A bidet according to claim 1, 2 or 3, wherein the casing further comprises a water filter and an air filter.

7. A bidet according to claim 3, wherein the casing further comprises a pulse device controlled from the outside of the casing and located upstream of the water distribution means for varying in a repetitive manner the pressure of the water sprayed by the nozzles.

8. A bidet according to claim 7, wherein the pulse device is provided with at least one opening for receiving additional means for delivering medicinal product doses into the water.

9. A bidet according to claim 1, 2 or 3, further comprises a control pedal connected to the casing for operating by foot all the bidet controls external to the casing.

* * * * *